US009874312B2

(12) United States Patent
Frenal et al.

(10) Patent No.: US 9,874,312 B2
(45) Date of Patent: Jan. 23, 2018

(54) CAP WITH A BRIM PROTECTING THE ROTARY CONTROL MEMBER OF A GAS CONTAINER VALVE UNIT

(71) Applicants: Air Liquide Santé International, Paris (FR); L'Air Liquide, Société Anonyme pour l'Etude et l'Exploitation des Procédés Georges Claude, Paris (FR)

(72) Inventors: Antoine Frenal, Ezanville (FR); Damien Germani, Paris (FR); Renaud Ligonesche, Herblay (FR); Beatriz Lopez, Paris (FR); Philippe Rudnianyn, Villiers sur Orge (FR); Chiara Tarantello, Puteaux (FR); Catherine Vivier, Sanit-Egrève (FR)

(73) Assignees: L'Air Liquide, Société Anonyme pour l'Etude et l'Exploitation des Procédés Georges Claude, Paris (FR); Air Liquide Santé (International), Paris (FR)

( * ) Notice: Subject to any disclaimer, the term of this patent is extended or adjusted under 35 U.S.C. 154(b) by 50 days.

(21) Appl. No.: 14/642,073

(22) Filed: Mar. 9, 2015

(65) Prior Publication Data

US 2015/0260345 A1 Sep. 17, 2015

(30) Foreign Application Priority Data

Mar. 12, 2014 (FR) ..... 14 52033

(51) Int. Cl.
*F17C 13/06* (2006.01)
*F17C 1/00* (2006.01)
*F17C 13/00* (2006.01)

(52) U.S. Cl.
CPC ..... *F17C 13/06* (2013.01); *F17C 1/00* (2013.01); *F17C 13/002* (2013.01);
(Continued)

(58) Field of Classification Search
CPC ..... F17C 2205/0308; F17C 2205/0311; F17C 2205/0329; F17C 2250/0404–2250/0482;
(Continued)

(56) References Cited

U.S. PATENT DOCUMENTS 340,774 A * 4/1886 Freeman ..... F16K 37/0008 137/556
4,586,634 A * 5/1986 Minter ..... F17C 13/04 137/322

(Continued)

FOREIGN PATENT DOCUMENTS

DE 100 57 469 5/2005
EP 0 629 812 12/1994

(Continued)

OTHER PUBLICATIONS

French Search Report and Written Opinion for corresponding FR 1452033, dated Dec. 18, 2014.

*Primary Examiner* — Craig Schneider
*Assistant Examiner* — Jonathan Waddy
(74) *Attorney, Agent, or Firm* — Allen E. White

(57) ABSTRACT

The invention relates to a gas distribution assembly comprising a gas container (20), such as a gas cylinder, a valve unit fixed to the gas container (20) and a protective cap (1, 2, 3, 4) arranged around the said valve unit, the protective cap (1, 2, 3, 4) comprising an opening (9) in which a rotary control member (5) is housed. The opening (9) is bordered by a protruding brim (7) jutting out from the external surface of the body (2) of the protective cap (1, 2, 3, 4). The protruding brim (7) comprises a cutout (8) forming a reading window so that marks or markings (11) corresponding to gas flow-rate values can be read.

17 Claims, 3 Drawing Sheets

(52) U.S. Cl.
CPC *F17C 2201/0109* (2013.01); *F17C 2201/032* (2013.01); *F17C 2201/058* (2013.01); *F17C 2205/0115* (2013.01); *F17C 2205/0165* (2013.01); *F17C 2205/0188* (2013.01); *F17C 2205/0308* (2013.01); *F17C 2205/0329* (2013.01); *F17C 2205/0338* (2013.01); *F17C 2205/0382* (2013.01); *F17C 2205/0394* (2013.01); *F17C 2221/011* (2013.01); *F17C 2221/014* (2013.01); *F17C 2221/017* (2013.01); *F17C 2221/03* (2013.01); *F17C 2221/031* (2013.01); *F17C 2223/0123* (2013.01); *F17C 2223/036* (2013.01); *F17C 2270/025* (2013.01)

(58) Field of Classification Search
CPC . F17C 2250/0491–2250/0495; F17C 2250/03; F17C 2250/0486; F17C 2250/0636; F17C 13/06
USPC ..... 137/382, 382.5, 553, 556; 220/581, 582, 220/724, 751; 215/28
See application file for complete search history.

(56) References Cited

U.S. PATENT DOCUMENTS 4,600,033 A 7/1986 Baron
5,099,567 A 3/1992 Kitsuda
5,429,152 A 7/1995 Van Straaten et al.
6,820,647 B1 * 11/2004 Grecco ..... F16K 31/041 137/137
2001/0047998 A1 * 12/2001 Carlo ..... F17C 13/04 220/724
2003/0051755 A1 * 3/2003 Cannet ..... F16K 1/304 137/505.38
2004/0020793 A1 2/2004 Peterolff et al.
2004/0221919 A1 * 11/2004 MacNeal ..... F16L 29/02 141/384
2005/0238555 A1 * 10/2005 Zaiser ..... G05D 16/103 423/121
2007/0204919 A1 * 9/2007 Shin ..... F17C 1/00 137/587
2007/0257498 A1 * 11/2007 Swain ..... F17C 13/002 294/27.1
2008/0095607 A1 4/2008 Hagstrom et al.
2008/0110925 A1 * 5/2008 Hagstrom ..... A61M 16/10 222/3
2009/0038691 A1 2/2009 Birch et al.
2009/0050218 A1 * 2/2009 Burgess ..... F17C 13/06 137/557
2009/0272443 A1 * 11/2009 Lee ..... F16K 1/306 137/505.11
2011/0017324 A1 * 1/2011 Emanuel ..... E03B 7/09 137/556
2014/0251456 A1 * 9/2014 Cesbron ..... A61M 16/20 137/382

FOREIGN PATENT DOCUMENTS

EP 1 013 986 6/2000
EP 2 171 342 4/2010
EP 2 586 481 5/2013

* cited by examiner

CAP WITH A BRIM PROTECTING THE ROTARY CONTROL MEMBER OF A GAS CONTAINER VALVE UNIT

CROSS REFERENCE TO RELATED APPLICATIONS

This application claims the benefit of priority under 35 U.S.C. § 119(a) and (b) to French Patent Application No. 1452033 filed Mar. 12, 2014, the entire contents of which are incorporated herein by reference.

BACKGROUND

The invention relates to a gas distribution assembly comprising a gas cylinder, particularly a medical gas cylinder, a valve unit, with or without an in-built regulator system, fixed to the gas cylinder, and a protective cap arranged around the valve unit to protect it from knocks and dirt.

Industrial and medical gases are commonly packaged at high pressure into gas containers, typically gas cylinders, equipped with a valve unit which may or may not incorporate an in-built regulator, namely a simple valve of the open/closed type or a valve with an in-built regulator, also referred to as a regulator valve RDI, so that the flow rate and pressure of the gas delivered can be controlled.

In order to protect this valve unit it is commonplace to fit around the said valve unit a protective cap that forms a protective shell around the body of the valve. Such a cap is often referred to as a "bonnet". Caps of this type are described notably in documents EP-A-629812, DE-A-10057469, US-A-2004/020793 and EP-A-2586481.

Control of the flow of gas through the valve unit is usually had via a gas-passage control system arranged on the internal gas passage which fluidically connects the gas container to an output orifice of the valve unit, the said gas-passage control system generally collaborating with a control member that can be operated by a user, typically a rotary handwheel.

It has been found in practice that while the protective cap affords the body of the valve unit good protection against knocks, it does not do the same for the rotary handwheel when the latter is arranged on the front or on one of the lateral faces of the cap and/or of the valve unit.

What happens is that the rotary handwheel can easily be damaged if the cylinder falls onto the ground because it generally extends beyond the surface of the cap and is therefore exposed if the cylinder falls over or if two cylinders bang together when stored side by side.

Document EP-A-1013986 proposes a protective cap for a gas cylinder comprising a wide opening on the front face thereof, which opening provides access to the various components of the valve around which it is arranged. Such a solution is not ideal since, because of the wide opening made in the cap, dust or the like can enter the cap, presenting problems of hygiene, particularly when the cylinder is to be used in a hospital or similar environment.

In addition, although incorporating into the cap the handwheel that controls the release of the flow rate of gas provides it with protection against falls, a problem of precise adjustment of the gaseous flow rate and of reading the selected flow rate value arises.

Alternative solutions are given in documents U.S. Pat. No. 5,099,567, U.S. Pat. No. 4,600,033, WO-A-2008/149312 and US-A-2009/0038691. However, none of these is truly satisfactory because they all present problems which are notably identical or similar to those mentioned hereinabove.

The problem that arises is that of improving the protection of the rotary handwheel with which the valve unit of a gas distribution assembly is equipped, this gas distribution assembly comprising a gas cylinder, a valve unit, with or without an in-built regulator system, fixed to the gas cylinder, and a protective cap arranged around the valve unit, in which distribution assembly control over the release of the flow of gas is had by means of a control member of the rotary handwheel type that can be operated by a user, while at the same time affording the valve elements good protection and guaranteeing a level of hygiene compatible with use in the health domain in particular.

SUMMARY

The solution of the invention is therefore a gas distribution assembly comprising a gas container, a valve unit fixed to the gas container and a protective cap arranged around the said valve unit, the protective cap comprising an opening in which a rotary control member is housed, characterized in that the opening is at least partially bordered by a protruding brim jutting out from the external surface of the protective cap, the protruding brim comprising a cutout forming a reading window.

Depending on the circumstance, the assembly of the invention may comprise one or more of the following technical features:

- The opening is situated in the front face of the cap, i.e. on the facade of the cap.
- The protruding brim extends over at least part of the upper periphery of the opening.
- The protruding brim forms a visor jutting out beyond the rotary control member.
- The cutout forming the reading window is shaped as a U, a V, a square or the like.
- The rotary control member bears several markings corresponding to gas flow rates, the cutout forming a reading window being formed in the protruding brim so as to be positioned facing at least one of the markings borne by the rotary control member so as to allow a user to see the said at least one marking through the said reading window.
- The markings are arranged in a ring in a peripheral region of the rotary control member, preferably as a complete or near-complete ring.
- The markings comprise increasing flow rate indications.
- The markings comprise increasing flow rate indications between 0 and 40 l/min, preferably between 0 and 25 l/min.
- The valve unit is of the type which may or may not have an in-built regulator.
- The rotary control member is a rotary handwheel.
- Means of holding are formed in the central region of the rotary control member, preferably the rotary handwheel.
- The rotary handwheel has an overall shape of revolution, for example the shape of a disc or the like.
- The protruding brim is situated facing at least part of the peripheral region of the rotary control member on which the flow rate markings are featured.
- The means of holding borne by the central region of the rotary control member comprise one or more elements in relief and/or housings able and designed to be grasped by the user between his fingers.

The opening in which the rotary control member is situated is formed in the front face of the protective cap.

The opening has a dimension corresponding to all or part of that of the rotary control member, particularly that of the rotary handwheel.

The means of holding borne by the central region of the rotary control member are arranged in such a way as to become positioned in the opening of the cap.

The rotary control member, particularly the means of holding borne by the rotary control member, is(are) arranged in such a way as to become positioned in the opening of the cap and to close off the said opening.

The markings comprising the flow rate indications can be read only through the cutout forming the reading window.

The protruding brim bordering the said opening has a maximum width of less than 5 cm, preferably of less than or equal to 3 cm.

The protruding brim comprises one or more markings indicative of the direction in which the user needs to turn the rotary control member in order to increase or in order to decrease the flow rate of gas delivered by the valve unit.

The protruding brim is formed as one with at least part of the front face of the cap, for example by moulding.

The rotary control member comprises means of holding.

The rotary control member comprises means of holding and markings corresponding to gas flow rates, the said markings being positioned around the means of holding.

The rotary control member is designed and arranged in such a way that when the user turns the rotary control member by a manual/finger action on the means of holding, markings are made to scroll past the cutout that forms the reading window.

The valve unit comprises a gas outlet orifice borne by a gas outlet connection, the rotary control member being able to move in terms of rotation about the said gas outlet connection.

The rotary control member collaborates with a gas flow-rate control system arranged in the valve unit, when operated by the user, in order to control the flow rate of gas leaving the valve unit via the gas outlet orifice.

The gas flow-rate control system comprises a mobile element bearing calibrated orifices of increasing dimensions corresponding to increasing gas flow-rate values.

The mobile element of the gas flow-rate control system is a rotary disc. This rotary disc is pierced with calibrated orifices.

The rotary handwheel collaborates in rotation with the mobile element of the gas flow-rate control system in order to control the flow rate of gas delivered by the valve unit.

The gas container is a gas cylinder sometimes referred to as a bottle.

The protective cap comprising an opening formed in the upper part of the protective cap and within which a pressure gauge is housed, which means to say that the opening is formed through the wall of the cap.

The protective cap comprises a planar surface in its upper part, the opening comprising the pressure gauge being formed in the said planar surface.

The planar surface forms a face that is oblique with respect to the vertical axis of the cap.

The cap is made of a polymer material, for example of a plastic, of a composite, or of a metal or metal alloy, for example of steel, cast iron, aluminium or an aluminium alloy.

The cap is made of plastics material such as PVC, PE, PET, PP, PMMA, PU or PA.

The protective cap comprises a carry handle, preferably a carry handle connected to the cap by one or more support uprights. The carry handle is fixed, i.e. non-mobile.

The carry handle is arranged on the cap in such a way that the pressure gauge is positioned substantially between the carry handle and the valve unit bearing the said pressure gauge.

The protective cap further comprises an attachment device, preferably a pivoting attachment device, allowing the assembly to be hooked onto a support, particularly a bar of a bed, to a stretcher, etc.

The protective cap comprises an attachment device that can pivot with respect to the body of the cap.

The protective cap comprises a pivoting attachment device comprising one or more attachment hooks or arms.

The protective cap comprises a pivoting attachment device fixed to the rear face of the cap. The rear face of the cap is the face of the cap that is diametrically opposite the front face of the cap in which the opening bordered by the protruding brim is made.

The carry handle and/or the support upright(s) are formed of a rigid material selected from polymers and metals or metal alloys.

The carry handle is longiform overall. Typically, its length is between 5 and 20 cm, preferably between 6 and 15 cm.

The carry handle surmounts the cap body.

The carry handle is horizontal or near-horizontal and is perpendicular to the axis of the cap.

The gas cylinder has a size of between 10 and 150 cm.

The gas cylinder contains 0.5 to 20 liters (water-equivalent capacity).

The gas cylinder has a hollow cylindrical body and comprises a neck bearing a gas outlet orifice to which the valve unit is fixed, preferably by screwing.

The gas cylinder contains a gas or gaseous mixture, preferably a gas or gaseous mixture that meets the specifications of the medical domain (pharmacopoeia).

The gas cylinder contains a gas or gaseous mixture chosen from oxygen, air, an $N_2O/O_2$ mixture, an $He/O_2$ mixture, an NO/nitrogen mixture or any other gas or gaseous mixture.

The cylinder is made of steel, of aluminium alloy, of a composite or of a combination of these.

The cylinder contains gas at a pressure ranging up to around 350 bar.

The assembly of the invention is well suited to a use for storing and distributing a gas or a gaseous mixture, notably a medical gas, chosen from oxygen, air, an $N_2O/O_2$ mixture, an $He/O_2$ mixture, an NO/nitrogen mixture or any other gas or gaseous mixture.

BRIEF DESCRIPTION OF THE DRAWINGS

The invention will now be better understood from the following detailed description given by way of nonlimiting illustration with reference to the attached figures among which.

DESCRIPTION OF PREFERRED EMBODIMENTS

Figure 1:
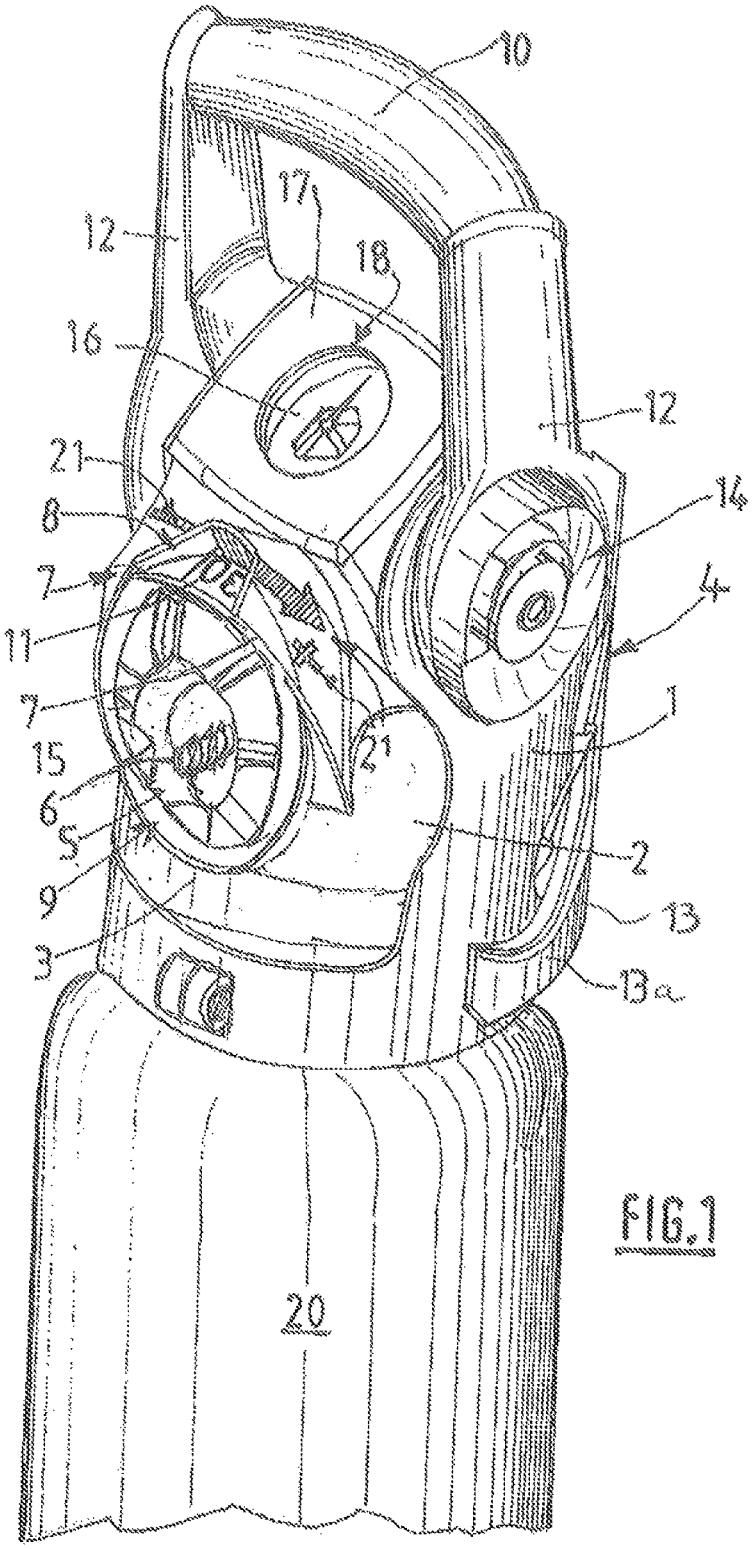
FIG. 1 depicts a ¾ front view of one embodiment of a cylinder/valve unit/cap assembly according to the invention.
Figure 2:
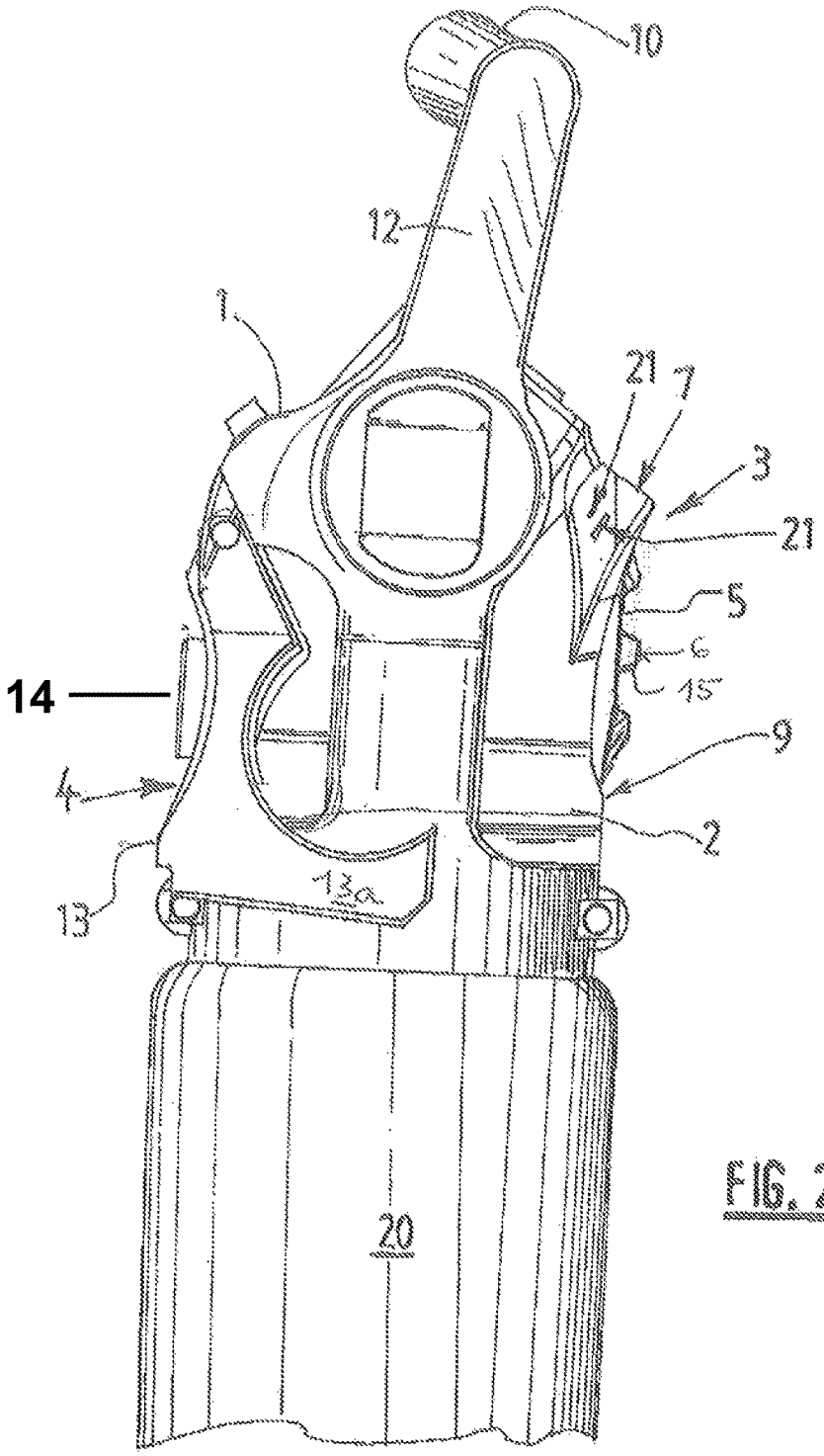
FIG. 2 is a view of the cap of the assembly of FIG. 1, from the left side.
Figure 3:
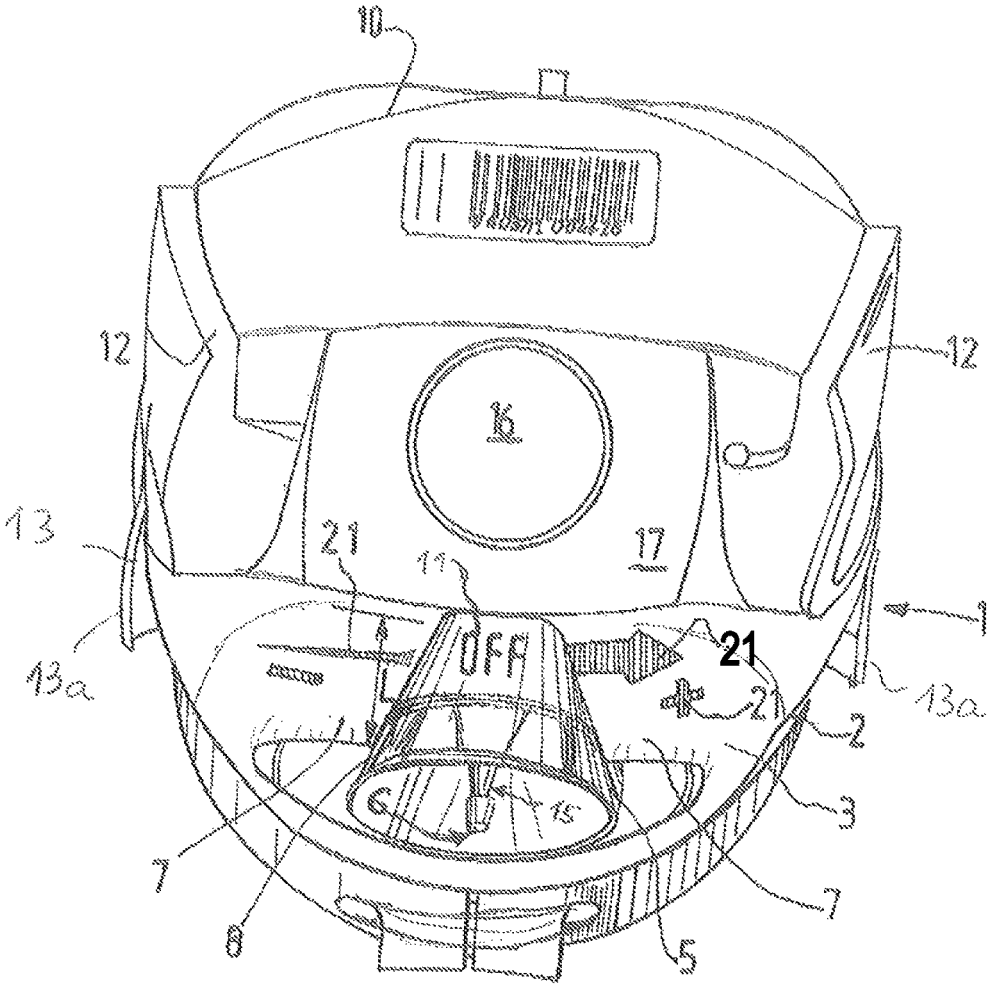
FIG. 3 is a view of the cap of the assembly of FIG. 1, from above.

FIGS. 1 to 3 depict one embodiment according to the invention of an assembly comprising a rigid protective cap 1, commonly referred to as a "bonnet", arranged around a valve unit (not visible), namely a valve unit with or without an in-built regulator, itself fixed to the neck of a gas cylinder 20. The protective cap 1 is provided with a carry handle 10 surmounting the cap body. The protective cap 1 is fixed to the neck of the cylinder or directly to the valve unit.

The protective cap 1 affords the valve unit protection against knocks, in the event of falling or of cylinders that bang together.

The gas cylinder 20 typically has a cylindrical body and a size of between 10 and 150 cm, and a capacity of 0.5 to 20 liters (in water equivalent). The cylinder may be made of steel or of aluminium alloy, or of a composite or of a combination of these.

Attachment around the valve unit to the neck of the gas cylinder 20 is by screwing, via mutually engaging screw threads borne by the internal surface of the neck of the cylinder 20, on the one hand, and by the external surface of an expansion of substantially cylindrical or conical shape situated at the base of the valve body and bearing a gas inlet orifice, on the other hand.

More specifically, the protective cap 1 comprises a cap body that forms a protective shell 2 around an internal volume dimensioned to accommodate the valve unit, and a carry handle 10 designed to be taken in hand by a user.

The body of the cap 1 is typically made of a material of the polymer and/or metal type, preferably of a plastic material such as PVC, PE, PET, PP, PMMA, PU, PA, etc.

The carry handle 10 is itself made of a rigid material such as a polymer or a metal or metal alloy, and is borne by one or more support uprights 12 that mechanically connect the cap body 2 to the carry handle 10. The carry handle 10 is generally arranged horizontally, i.e. at right angles or near right angles to the vertical axis of the cylinder 20 and of the cap 1. The carry handle 10 has a longilinear shape, whether straight or curved, typically a length less than 20 cm, typically from 6 to 15 cm. It may carry a bar code or the like for identification, as illustrated in FIG. 3.

One or more support uprights 12 are fixed to the carry handle 10 to allow a user easily to transport the assembly comprising the bonnet 1, the valve and the cylinder 20 using the said carry handle 10. The support uprights 12 may be made of a plastic material, like the body of the cap 1, but may also be made of aluminium alloy or of any other metallic material. They may be fixed to the handle 10 by screwing or welding for example.

The protective cap 1 also has openings 9, 18, 14 providing access to the valve unit situated in the internal volume of the cap body. In particular, a first opening 9 is formed on the front face 3 of the protective cap 1, and in this opening is housed a rotary control member 5, namely a rotary handwheel, which the user can operate in order to control or adjust the flow rate of gas delivered by the valve.

In order to allow the handwheel 5 to be turned, means of holding are provided that allow the user to grasp the rotary control member 5 between his fingers and turn it, as detailed hereinbelow.

In other words, the rotary handwheel 5 collaborates with a gas flow-rate control system, when operated by the user, so as to control the passage of gas, namely allow it to leave or prevent it leaving the valve unit.

By action on this rotary handwheel 5, the user can choose or regulate the flow rate of gas delivered by the valve unit, or on the other hand can shut it off completely. The rotary control member 5 according to the present invention is detailed hereinafter.

The protective cap 1 also comprises a second opening 18 in which a pressure gauge 16, either of the dial and pointer or of the electronic type, is housed. More specifically, the protective cap 1 comprises a planar surface 17 situated at the top of the cap 1 and on the same side as the front face 3 thereof, in which surface the second opening 18 is formed. The planar surface 17 in fact constitutes a face that is oblique with respect to the vertical axis of the cylinder 20. Arranging the pressure gauge 16 in this way at the top on the valve unit and the cap 1, and on the facade 3 of the said cap 1 makes it considerably easier to read the pressure delivered by the pressure gauge 16 and therefore avoid reading errors.

Moreover, the protective cap 1 comprises other openings providing access to connections for filling 14, for letting out gas under pressure (not shown), etc., which are situated laterally or on the rear face 4 of the cap body 1, as visible in FIGS. 1 and 2.

In the embodiment of FIGS. 1 and 2, the rotary handwheel 5 is arranged around the gas outlet connection 15 bearing the gas outlet orifice 6 used for withdrawing the gas stored in the cylinder 20, i.e. in a coaxial manner.

Furthermore, in order to allow the cylinder/valve unit/cap assembly to be attached or secured to a support, such as a hospital bed bar or the bar of a stretcher, the protective cap 1 comprises, on the same side as the rear face 4 thereof, a pivoting attachment device 13, able to pivot between a fully folded "rest" position (depicted schematically in FIGS. 1 and 2), namely the position adopted by the attachment device 13 when stored and in contact or near-contact with the body 2 of the cap 1, and a fully unfolded "attachment" position (not shown), namely the position adopted by the attachment device 13 when it is completely deployed and can be hooked onto a support, such as a bed bar or the like. To do that, the pivoting attachment device 13 is provided with two attachment hooks or arms 13*a*, as visible in FIGS. 1 and 3.

Advantageously, the valve unit is of the regulator valve type, namely comprises a gas pressure regulating system arranged between the gas passage control system and the gas outlet orifice 6 so as to reduce the pressure of the high-pressure gas coming from the cylinder 20 down to a lower pressure value delivered by the outlet orifice 6, for example to reduce pressure from a high pressure in excess of 100 bar to a low pressure lower than 20 bar abs. To this end, in the conventional way, a regulator system notably comprising a high-pressure chamber, a regulating valve and a valve seat, is provided. The final pressure may have an adjustable or fixed value.

As already explained, the rotary handwheel 5 collaborates with the gas flow-rate control system arranged on an internal gas passage of the valve unit in order to control or adjust the passage or flow rate of gas through the internal gas passage, namely in order to allow or, conversely, prevent any circulation of gas through the said passage in the direction from the gas inlet orifice positioned at the neck of the cylinder 20 to the gas outlet orifice 6 borne by the outlet connector 15.

Typically, the flow rate control system comprises an element pierced with calibrated orifices, the handwheel, as appropriate, either causing a calibrated orifice corresponding to the desired flow rate to collaborate with a fixed passage orifice or causing a mobile passage orifice to collaborate with the calibrated orifice corresponding to the desired flow rate. Such an arrangement is conventional and known to those skilled in the art.

For preference, the element pierced with calibrated orifices is a metal disc capable of rotation and through which calibrated orifices pass. The orifices are of different, i.e. increasing, calibres, each calibre corresponding to a given flow rate value. This disc is capable of rotational movement and is driven by the handwheel 5.

The rotary handwheel 5 which constitutes the control member that collaborates with the gas flow-rate control system is capable of rotational movement about an axis of rotation AA.

Schematically, when the user turns the handwheel 5, the latter acts directly or indirectly on the metal disc capable of rotating and through which calibrated orifices pass so as to allow a greater or lesser flow rate of gas to pass into the gas passage of the valve unit headed toward the outlet orifice 6, the said flow rate corresponding to the opening defined by the calibrated orifice through which the stream of gas passes.

As visible in FIG. 1, the opening 9 in which the rotary handwheel 5 is housed is, according to the invention, partially bordered by a protruding brim 7 jutting out from the external surface of the front face 3 of the body 2 of the protective cap 1, namely in the manner of a cap visor.

Advantageously, the protruding brim 7 extends over at least part of the upper periphery of the opening 9. As may be seen in FIGS. 1 and 2, the protruding brim 7 extends over the upper half of the circular periphery of the circular opening 9 in which the rotary handwheel 5, which also has a circular periphery, is housed.

This protruding brim 7 is preferably rigid. It also comprises a cutout 8 forming a reading window that becomes positioned facing at least one of the markings 11 borne by the rotary control member 5, as explained hereinafter, so as to allow a user to see this flow rate marking 11 through the reading window 8. The markings 11 are therefore legible and visible only through the cutout 8 that forms the reading window.

The cutout 8 that forms the reading window is U-shaped in this instance; however, it could have some other shape, for example a V-shape, an open or closed O-shape, a square shape, a rectangle shape, or any other shape that allows the marking 11 situated underneath to be read.

In other words, the rotary control member 5, typically a rotary handwheel, is therefore designed and arranged in such a way that a turning of the rotary control member 5, by a manual/finger action on the part of the user on the means of holding causes markings 11 to scroll past the cutout 8 that forms a reading window.

The protruding brim 7 also allows the handwheel 5 to be protected well in the event of the cylinder 20 falling onto its front face 3. This protruding brim 7 is preferably formed of one piece with all or part of the body 2 of the cap 1, notably the front face 3 thereof.

Figure 4:
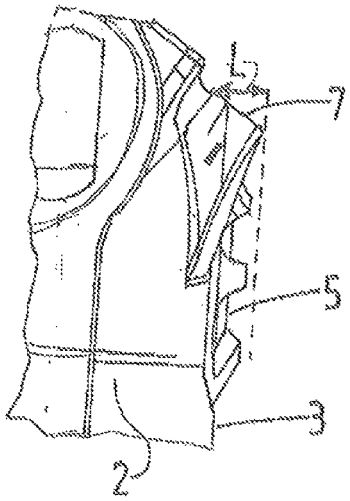
FIG. 4 is a partial view of the front face of the cap of the assembly of FIG. 1.

As illustrated in FIG. 4, the protruding brim 7 forms a visor jutting out beyond the rotary control member 5 so as to be able to absorb an impact, in the event of the cylinder 20 falling onto the ground or in the event of two cylinders banging together when stored side by side, because it is this brim 7 that will be the first to come into contact with the ground, making it possible to spare the connection any damage. For preference, the maximum width L of the brim is less than 5 cm, typically of the order of 3 cm or less.

Moreover, the protruding brim 7 comprises one or more marks 21, for example arrows and/or "+" and/or "−" symbols indicative of the direction in which the user needs to turn the rotary control member 5 in order to increase and/or in order to decrease the flow rate of gas delivered by the valve unit, namely in the clockwise or anticlockwise directions.

More specifically, as illustrated in the figures, the rotary handwheel 5 comprises a central region with the axis of rotation AA and a peripheral region situated at the periphery of the central region. The central region comprises means of holding allowing the user to grasp the rotary control member 5 between his fingers and turn it about the axis of rotation AA thus causing the markings 11 to scroll past the reading window formed by the cutout 8.

The means of holding borne by the central region of the rotary control member comprise one or more elements in relief and/or housings, i.e. recesses or cavities, able and designed, which means to say dimensioned, to be grasped by the user between his fingers. These elements in relief and/or housings are, for example, formed of small walls obtained by moulding of the component that forms the handwheel 5.

Advantageously they are formed on the exterior surface of the central region of the rotary control member 5, which is typically a rotary handwheel.

As illustrated in the figures, the rotary handwheel 5 has an overall shape of revolution, for example an overall shape of a disc or the like.

Moreover, the central region of the control member 5 further comprises a central orifice through which the outlet connection 15 bearing the outlet orifice 6 passes. The control member 5 is therefore free to rotate about the said outlet connection 15.

Moreover, the peripheral region 10 for its part comprises markings 11 which are mutually angularly offset with respect to the axis AA, the said markings 11 each corresponding to a given gas flow rate. In this instance, the markings 11 are arranged in a ring situated over the entire periphery of the central region and indicate increasing values of flow rate.

Thus, one of the markings 11 corresponds to a position of the handwheel 5 in which the gas is shut off, namely in which the valve 1 does not deliver gas (i.e. flow rate is =0 l/min), namely the marking "OFF". The other markings 11 correspond to positions of the handwheel 5 in which the gas is delivered at different flow rates, namely the flow rates of 0.5, 1, 1.5, 2, 3, 4, 6, 8, 10, 15 and 25 l/m in of gas.

The markings 11 may be engraved, printed, bonded or applied by any other suitable technique. Likewise the markings 11 may comprise numerals, letters or any other type of marks.

In general, the rotary handwheel 5 is preferably made of plastics material, such as PVC, PE, PET, PP, PMMA, PU, PA, etc., but may also be made of an aluminium alloy or of any other metallic material, or even of a combination of several materials, for example of plastics and metals.

For preference, at least part of the rotary handwheel 5 is made of a rigid material covered with a soft material that has a Shore hardness of between 0 and 95, for example a coating formed of a paint which gives what is referred to as a "soft touch" effect (i.e. an effect that is soft and silky to the touch) so as to increase user comfort for the user, or alternatively with a coating formed of an overmoulded layer of an elastomeric, silicon or similar material.

An assembly according to the invention is particularly well suited to use in a medical environment, namely in the healthcare domain, and in particular is suited to the storage of any medical gas or gaseous mixture, particularly of the oxygen, air, $N_2O/O_2$, $He/O_2$, NO/nitrogen or other type.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

The invention claimed is:

1. A gas distribution assembly comprising a gas container, a valve unit fixed to the gas container and a protective cap arranged around said valve unit, the protective cap comprising an opening in which a rotary control member is housed, wherein the opening is at least partially bordered by a protruding brim jutting out from an external surface of the body of the protective cap, the protruding brim comprising a cutout forming a reading window and wherein the protruding brim forms a visor jutting out beyond the rotary control member.

2. The assembly of claim 1, wherein the protruding brim extends over at least part of an upper periphery of the opening.

3. The assembly of claim 1, wherein the rotary control member bears several markings corresponding to gas flow rates, the cutout forming the reading window being formed in the protruding brim so as to be positioned facing at least one of the markings borne by the rotary control member so as to allow a user to see the said at least one marking through said reading window.

4. The assembly of claim 3, wherein the markings comprising the flow rate indications can be read only through the cutout forming the reading window.

5. The assembly of claim 1, wherein the rotary control member comprises one or more elements in relief and/or housings able and designed to be grasped by the user between his fingers.

6. The assembly of claim 5, wherein the one or more elements in relief and/or housings able and designed to be grasped by the user between his fingers are around a center of the rotary control member.

7. The assembly of claim 1, wherein the rotary control member comprises one or more elements in relief and/or housings able and designed to be grasped by the user between his fingers and markings corresponding to gas flow rates, the markings being positioned around the one or more elements in relief and/or housings able and designed to be grasped by the user between his fingers.

8. The assembly of claim 7, wherein the one or more elements in relief and/or housings able and designed to be grasped by the user between his fingers are positioned in the opening of the cap.

9. The assembly of claim 7, wherein the rotary control member is designed and arranged in such a way that when the user turns the rotary control member by a manual/finger action on the one or more elements in relief and/or housings able and designed to be grasped by the user between his fingers, markings are made to scroll past the cutout that forms the reading window.

10. The assembly of claim 1, wherein the rotary control member is a rotary handwheel.

11. The assembly of claim 1, wherein the protruding brim comprises one or more markings indicative of the direction in which the user needs to turn the rotary control member in order to increase or in order to decrease the flow rate of gas delivered by the valve unit.

12. The assembly of claim 1, wherein the valve unit comprises a gas outlet orifice borne by a gas outlet connection, the rotary control member being able to move in terms of rotation about said gas outlet connection.

13. The assembly of claim 1, wherein the rotary control member collaborates with a gas flow-rate control system arranged in the valve unit, when operated by the user, in order to control the flow rate of gas leaving the valve unit via a gas outlet orifice.

14. The assembly of claim 1, wherein the protective cap further comprises a carry handle and an attachment device.

15. The assembly of claim 14, wherein the attachment device is a pivoting attachment device.

16. A method of distributing a gas or gaseous mixture chosen from oxygen, air, $N_2O/O_2$, $He/O_2$ and NO/nitrogen comprising the step of rotating a rotary control member of a gas distribution assembly, the gas distribution assembly comprising a gas container, a valve unit fixed to the gas container and a protective cap arranged around said valve unit, the protective cap comprising an opening in which the rotary control member is housed, wherein the opening is at least partially bordered by a protruding brim jutting out from an external surface of the body of the protective cap, the protruding brim comprising a cutout forming a reading window and wherein the protruding brim forms a visor jutting out beyond the rotary control member.

17. The method of claim 16, wherein the gas container is a gas cylinder.

* * * * *